US010478741B2

(12) United States Patent
Heo

(10) Patent No.: US 10,478,741 B2
(45) Date of Patent: Nov. 19, 2019

(54) CHAIN BLOCK TOY FACILITATING CONNECTION AND PREVENTING ABRASION BY BEING ELASTICALLY OPERATED VIA LEFT AND RIGHT ROLLING

(71) Applicant: IRINGO CO., LTD, Incheon (KR)

(72) Inventor: In-Deok Heo, Incheon (KR)

(73) Assignee: IRINGO CO., LTD, Icheon (KR)

( * ) Notice: Subject to any disclaimer, the term of this patent is extended or adjusted under 35 U.S.C. 154(b) by 0 days.

(21) Appl. No.: 15/913,158

(22) Filed: Mar. 6, 2018

(65) Prior Publication Data

US 2018/0193763 A1 Jul. 12, 2018

Related U.S. Application Data

(63) Continuation of application No. PCT/KR2017/001614, filed on Feb. 14, 2017.

(30) Foreign Application Priority Data

May 16, 2016 (KR) ..... 10-2016-0059841

(51) Int. Cl.
*A63H 33/08* (2006.01)
*A63H 33/06* (2006.01)

(52) U.S. Cl.
CPC ..... *A63H 33/08* (2013.01); *A63H 33/062* (2013.01)

(58) Field of Classification Search
CPC .... A63H 33/08; A63H 33/065; A63H 33/084; A63H 33/102; A63H 33/062
USPC ..... 446/102, 120, 122, 124, 126
See application file for complete search history.

(56) References Cited

U.S. PATENT DOCUMENTS

| | | | | | |
|---|---|---|---|---|---|
| 3,748,778 | A | * | 7/1973 | Ellies | A63H 33/067 426/134 |
| 4,740,188 | A | * | 4/1988 | Coster | A63H 33/067 446/106 |
| 5,049,104 | A | * | 9/1991 | Olsen | A63H 33/042 403/156 |
| D394,091 | S | * | 5/1998 | Parry | D21/486 |
| 6,116,981 | A | * | 9/2000 | Zheng | A63H 33/065 446/106 |

FOREIGN PATENT DOCUMENTS

| | | | |
|---|---|---|---|
| JP | 2014-039789 | A | 3/2014 |
| KR | 10-0149507 | B1 | 10/1999 |
| KR | 20-0178749 | Y1 | 4/2000 |
| KR | 20-0401684 | Y1 | 11/2005 |
| KR | 20-2011-0009631 | U | 10/2011 |

* cited by examiner

*Primary Examiner* — Vishu K Mendiratta
(74) *Attorney, Agent, or Firm* — Jefferson IP Law, LLP

(57) ABSTRACT

The present disclosure relates to a chain block toy assembled by interconnecting multiple assembly blocks in a fitting manner by using a female coupling part and a male coupling part. In particular, in each of the assembly blocks provided with a plurality of female coupling parts defined by a partition, an open groove is formed in the partition for forming the plurality of female coupling parts such that, when coupling or decoupling a male coupling part or rotating same in a coupled state, vertical supports of the female coupling parts are rolled to the left and right sides, thereby facilitating the coupling and decoupling, while preventing abrasion by minimizing friction.

5 Claims, 11 Drawing Sheets

CHAIN BLOCK TOY FACILITATING CONNECTION AND PREVENTING ABRASION BY BEING ELASTICALLY OPERATED VIA LEFT AND RIGHT ROLLING

CROSS-REFERENCE TO RELATED APPLICATION(S)

This application is a continuation application, claiming priority under § 365(c), of an International Application No. PCT/KR2017/001614, filed on Feb. 14, 2017, which was based on and claimed the benefit of a Korean patent application number 10-2016-0059841, filed on May 16, 2016, in the Korean Intellectual Property Office, the disclosure of which is incorporated by reference herein in its entirety.

TECHNICAL FIELD

The present invention relates to a chain block toy assembled by interconnecting multiple assembly blocks in a fitting manner by using a female coupling part and a male coupling part, and more particularly, to a chain block toy, in which an assembly block having a plurality of female coupling parts is easily coupled to and decoupled from another assembly block and prevented from being abraded when the assembly block is rotated.

BACKGROUND

Recently, in the chain block toy used for the above purpose, the male coupling part of the assembly block is connected to the female coupling part of another assembly block in the form of a chain so as to be assembled into various types of structures having a flat or three-dimensional shape, so that the chain block toy may be used as a toy for developing creativity of children.

In such a chain block toy, as shown in FIG. 1, a male coupling part 200 is engaged with a female coupling part through a fitting scheme so as not to be unintentionally separated, while being freely rotatable within a range of 180° in a coupled state. To this end, the male coupling part 200 is formed at an inner center thereof with a guide groove 210, a concave groove 220 is formed at an edge of the male coupling part 200 at a predetermined interval, the female coupling part 100 is formed at an inner center thereof with a guide protrusion 130 fitted to the guide groove 210, and the female coupling part 100 is formed at one side thereof with a stopper protrusion 140 latched to the concave groove 220 to control rotation.

Accordingly, the chain block toy is coupled to be rotatable, and an angle is fixed in a rotated state, so that structures to be assembled may be assembled in various shapes.

Meanwhile, the assembly blocks are used in various forms so as to be assembled into structures having various shapes, and it is possible to assemble various structures by using various assembly blocks such as an assembly block having a male coupling part and a female coupling part, an assembly block having only a plurality of female coupling parts, an assembly block having only a male coupling part, an assembly block formed on both sides thereof with male coupling parts and formed at a center thereof with a plurality of female coupling parts, and an assembly block where a plurality of female coupling parts are provided by lengthening a female coupling part relative to a male coupling part.

In this case, the vertical coupling part 110 has a structure in which vertical supports 110 are vertically positioned and a coupling space 120 to which the male coupling part 200 is fitted is formed between the vertical supports 110. In order to form a plurality of female coupling parts 100, a partition 150 is necessary.

However, since the vertical supports 110 are firmly supported by the partition 150, coupling or decoupling of the male coupling part 200 in the coupling space 120 of the female coupling part 100 is tightly achieved as shown in FIG. 2.

In other words, a force for enabling forced coupling is required when infants or children with weak strength intend to couple the assembly blocks. However, it is very difficult for the infants and children to generate the force for enabling the forced coupling, so that assembly works for the assembly blocks may be very difficult.

In addition, when the assembly block is rotated for angle adjustment in a coupled state, the vertical support 110 firmly supported by the partition 150 generates powder caused by abrasion due to friction, and such abrasion reduces a lifespan of the assembly block, so that the assembly block cannot be used as an assembly block, and it causes hygiene and health problems when the infants or children eat the powder generated by the abrasion.

SUMMARY

To solve the problems described above, one object of the present invention is to allow a male coupling part to be easily coupled to and decoupled from a plurality of female coupling parts, and to prevent powder from being generated by abrasion due to friction when the assembly block is rotated in a coupled state, thereby enabling hygienic use.

To achieve the objects described above, according to the present invention as a technical idea, an assembly block has a plurality of female coupling parts, which are coupled with a male coupling part and defined by a partition between vertical supports that are arranged vertically, and an open groove is formed in the partition for forming the female coupling parts, such that when coupling or decoupling the male coupling part, or rotating the male coupling part in a coupled state, the vertical supports of the female coupling part are rolled to left and right sides, which facilitates the coupling and decoupling and prevents abrasion by minimizing friction.

In addition, the partition may be configured to have a width smaller than a width of the vertical support, and the partition may be disposed at a center between the vertical supports that are symmetrically arranged, such that the vertical support may be supported by the partition, and an elastic operation may be identically generated when the male coupling part is coupled to the female coupling part.

In addition, a reinforcing hole having a circular shape or a square shape, which is slightly larger than an incision width of the open groove, may be formed inward of the open groove formed in the partition, such that the elastic operation may be further improved, and an elastic resistance may be controlled to facilitate the coupling of the assembly blocks.

The open groove formed in the partition may be vertically arranged in multi-stages, or the open groove may be inclined toward an inner center from both outer ends of the partition at left and right sides of the partition, so that an identical elastic operation effect may be obtained.

Therefore, according to the chain block toy of the present invention, when the male coupling part is coupled to the female coupling parts, an elastic effect caused by the left and right rolling is maximized by the open groove formed in the partition, so that the infants or children can easily manipulate the coupling or decoupling, thereby improving the ease of use and the quality of products. In addition, a frictional force is minimized even when the assembly block is rotated in the coupled state, so that the powder generated by the abrasion are prevented from being generated, thereby providing safe play for children with the hygiene and health.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
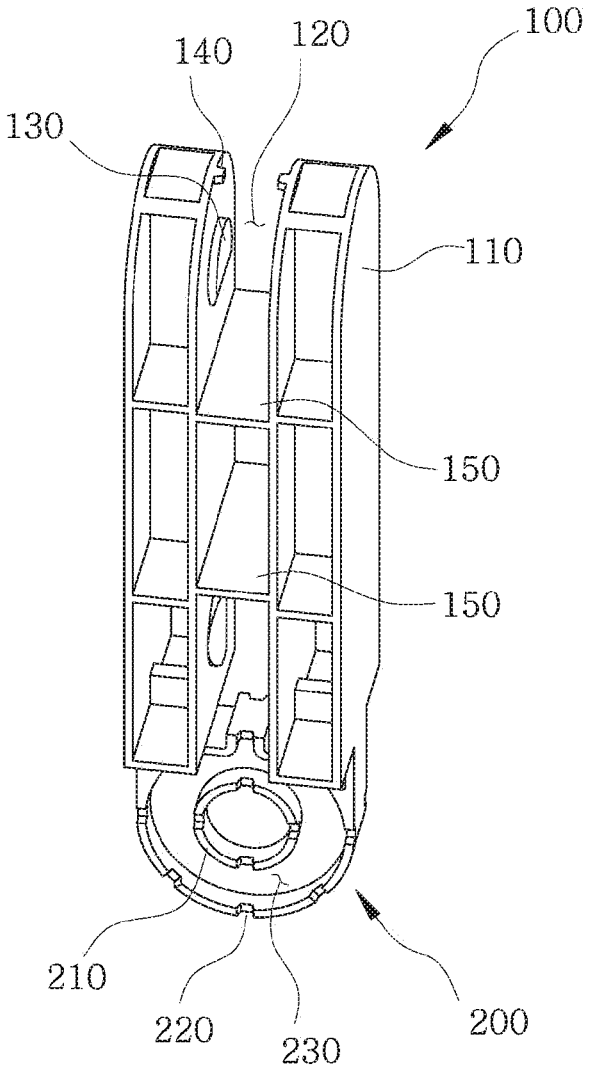
FIG. 1 is a view showing a state of a female coupling part according to the related art.
Figure 2:
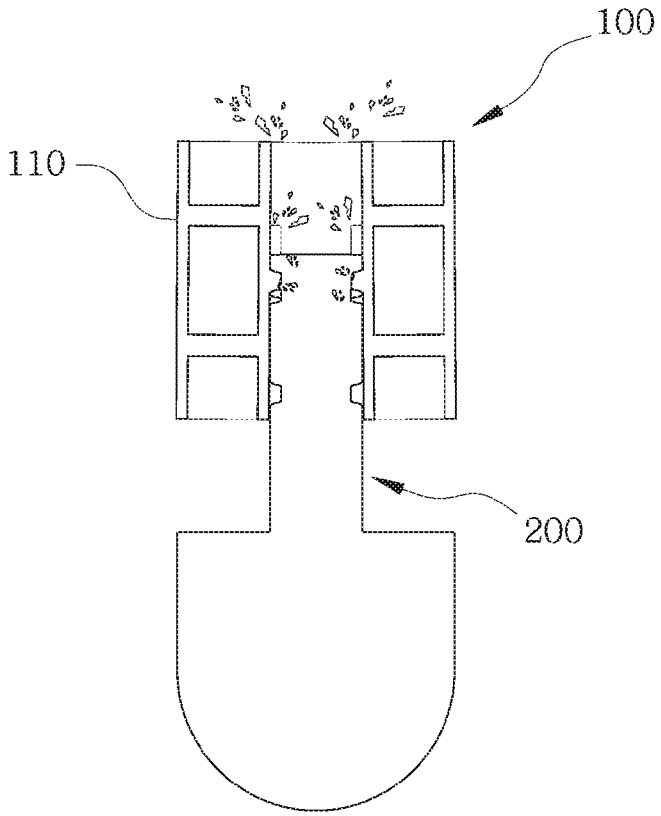
FIG. 2 is a sectional view showing a state in which a male coupling part is coupled to the female coupling part according to the related art.

The best mode for carrying out the invention is a chain block toy facilitating connection and preventing abrasion by being elastically operated via left and right rolling, wherein an assembly block has a plurality of coupling spaces 12 of a female coupling part 10, which is coupled with a male coupling part 20 and defined by a partition 15 between vertical supports 11 that are arranged vertically, and an open groove 16 is formed on left and right sides of the partition 15 for forming the coupling spaces 12 at the female coupling part 10, such that when coupling or decoupling the male coupling part 20, or rotating the male coupling part 20 in a coupled state, the female coupling part 10 is rolled to left and right sides, which facilitates the coupling and decoupling of the male coupling part 20 and prevents the male coupling part 20 from being abraded by minimizing friction when the male coupling part 20 is rotated.

Hereinafter, the present invention will be described in detail with reference to the accompanying drawings.

First, in the present invention, a male coupling part is coupled to a female coupling part so as to be assembled into various structures, and the present invention relates to an assembly block in which the male coupling part is not unintentionally separated from the female coupling part in a coupled state while being rotatable within a range of 180°.

In order to achieve such an assembly structure, a guide protrusion 13 is formed in a coupling space 12 of a female coupling part 10, and a guide groove 21 is formed in a male coupling part 20, such that at the time of the coupling of the male coupling part, the guide protrusion 13 is engaged with the guide groove 21 so as not to be unintentionally separated therefrom while being rotatable in a coupled state. In order to be fixed at a rotated angle during rotation, a stopper protrusion 14 is formed at one side of an edge of the coupling space 12 of the female coupling part 10, and the male coupling part 20 has a latching groove 22 in an edge wall which is formed by a concave surface 23. A vertical support 11 of the female coupling part 10 is formed at edges thereof with an inner wall and an outer wall that form a concave space 11*a*, which allows a product to be light in weight and facilitates molding during manufacture. However, the object of the present invention is not limited thereto.

Figure 3:
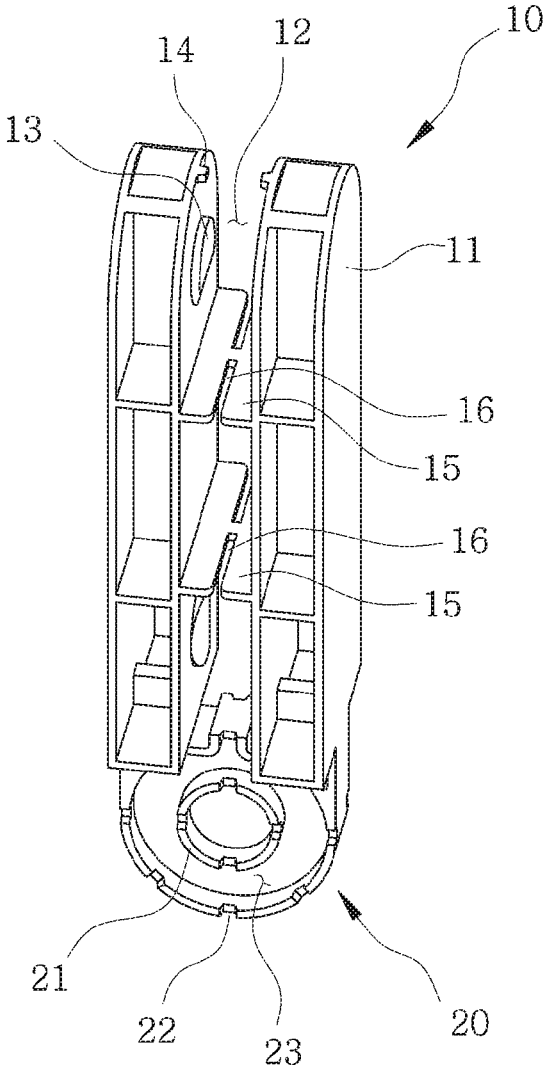
FIG. 3 is a view showing a state in which an open groove is formed in a partition for forming the female coupling part according to the present invention.
Figure 4:
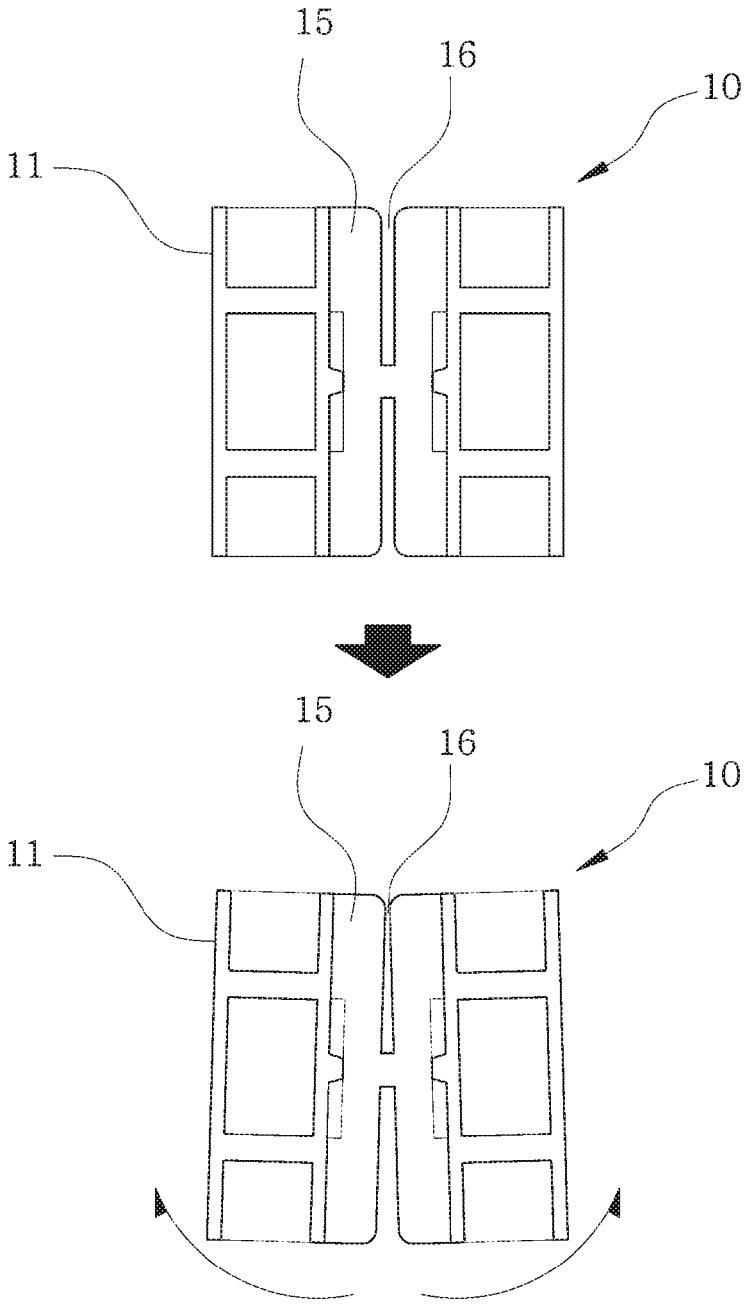
FIG. 4 is a sectional view showing a state in which the female coupling part is rolled to right and left sides by the open groove according to the present invention.
Figure 5:
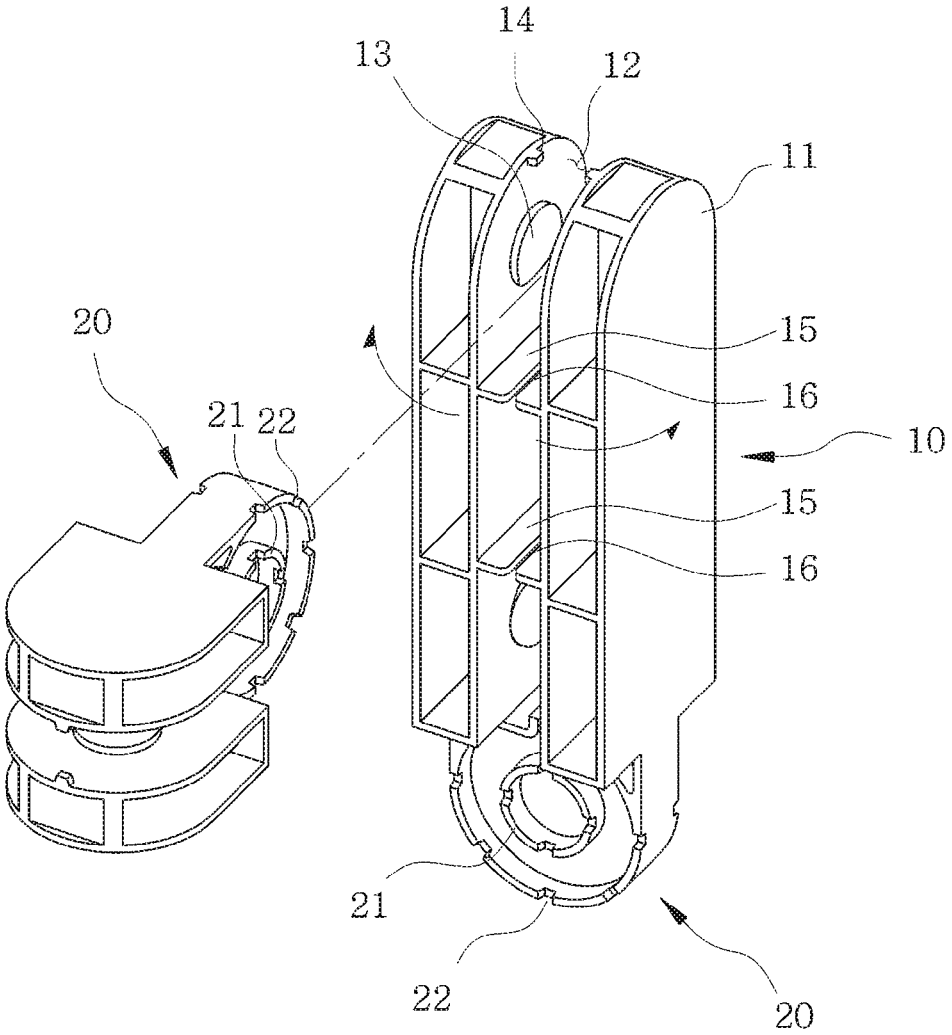
FIG. 5 is a view showing a state in which the male coupling part is coupled to the female coupling part according to the present invention.
Figure 6:
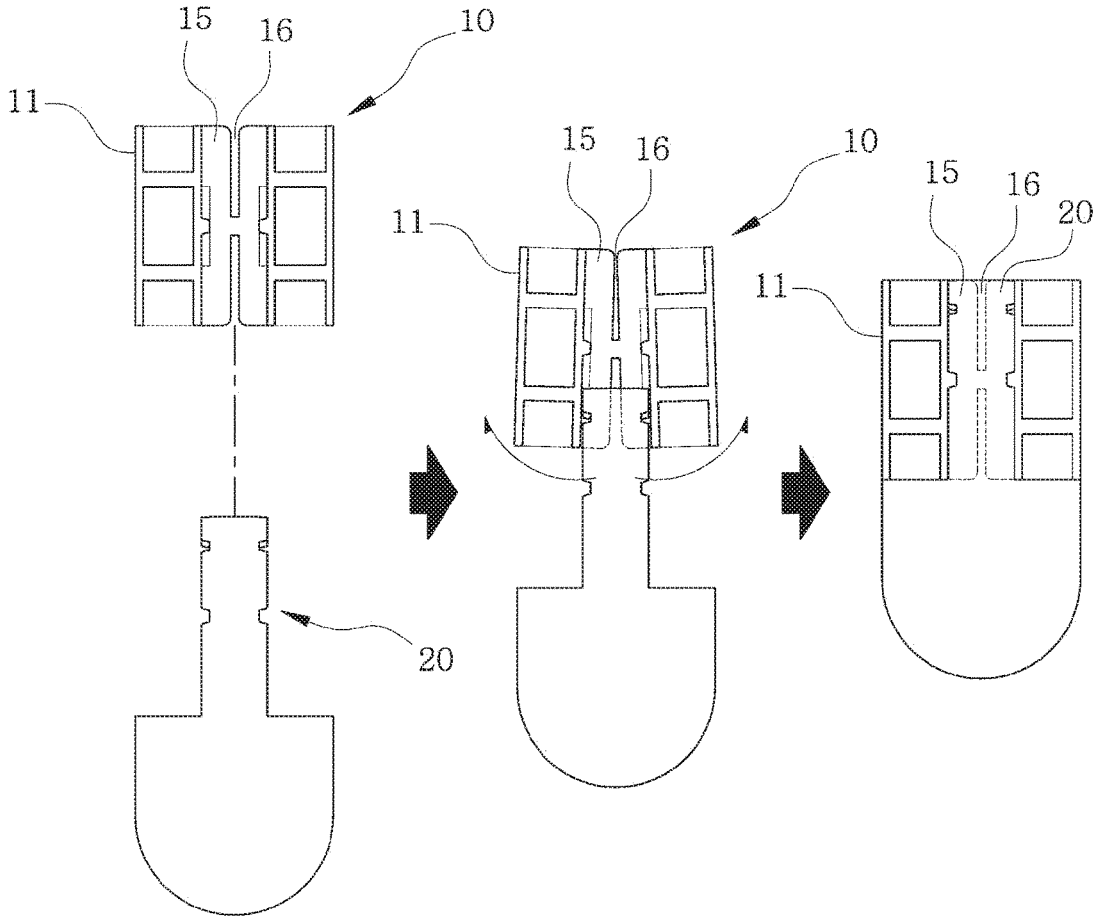
FIG. 6 is a view showing a state in which the male coupling part is coupled to the female coupling part by the left and right rolling of the female coupling part according to the present invention.

As shown in FIGS. 3 to 5, in the female coupling part 10 according to the present invention, a plurality of coupling spaces 12 to which the male coupling part 20 is coupled is formed by the partition 15 so as to assemble various structures, and an open groove 16 is formed on the left and right sides of the partition 15 for forming the coupling spaces 12.

Therefore, when the male coupling part 20 is coupled to or decoupled from the female coupling part 10, or the male coupling part 20 is rotated in the coupled state, the female coupling part 10 is rolled to the right and left sides by the open groove 16 formed in the partition 15, thereby facilitating the coupling and decoupling of the male coupling part 20, and preventing abrasion by minimizing friction through a rolling operation when the male coupling part 20 is rotated in the coupled state.

In other words, when the male coupling part 20 is coupled to the female coupling part 10 having the coupling spaces 12, an elastic operation caused by the rolling occurs corresponding to a width of the open groove 16 formed on the left and right sides of the partition 15, so that the coupling space 12 is spread in a direction in which the male coupling part 20 is inserted, and an opposite direction is contracted so as to perform the coupling. When the coupling is completed, the coupling space 12 is restored to an original state, thereby achieving precise engagement.

Figure 7:
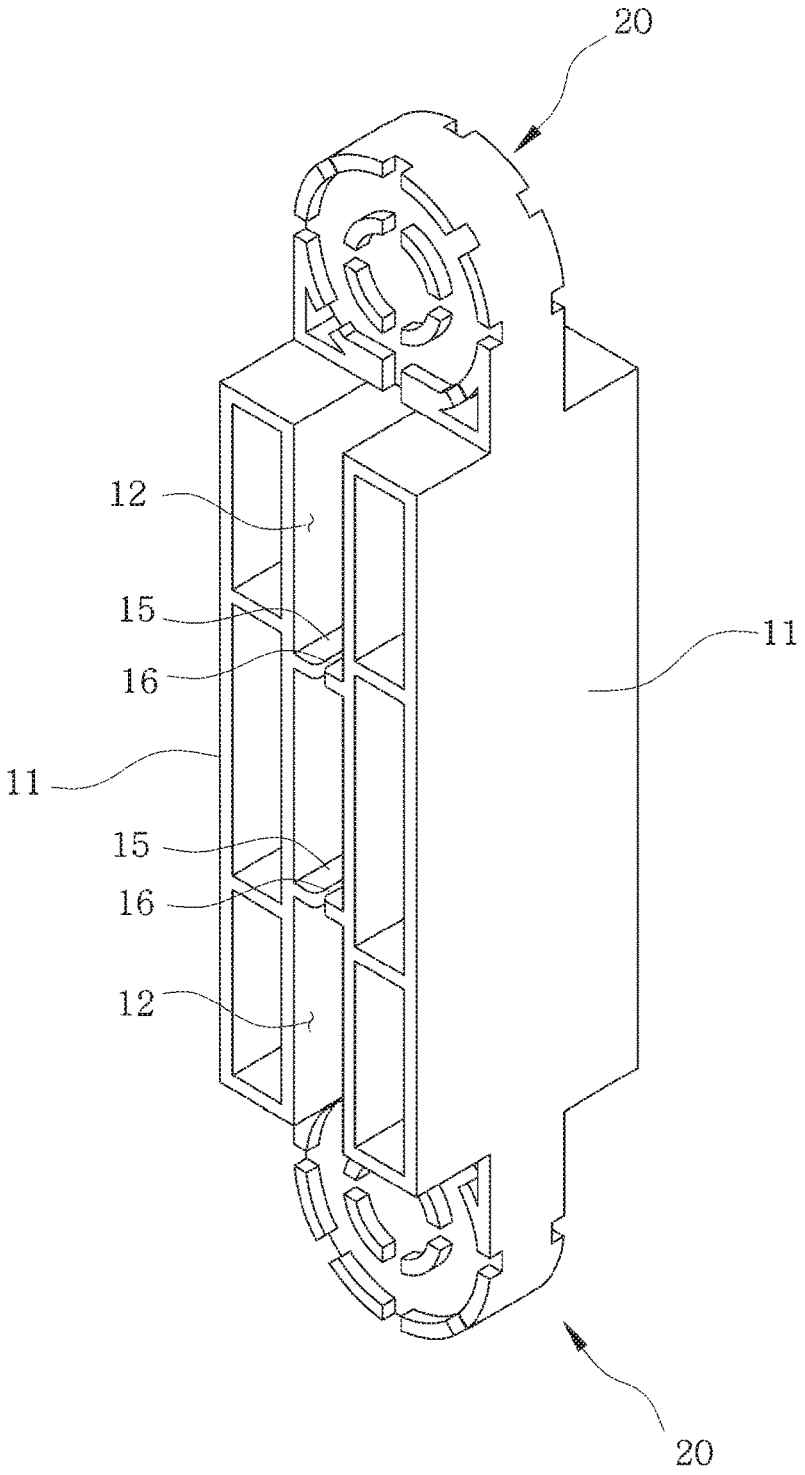
FIGS. 7, 8 and 9 are perspective views showing various assembly blocks having the female coupling part according to the present invention.
Figure 8:
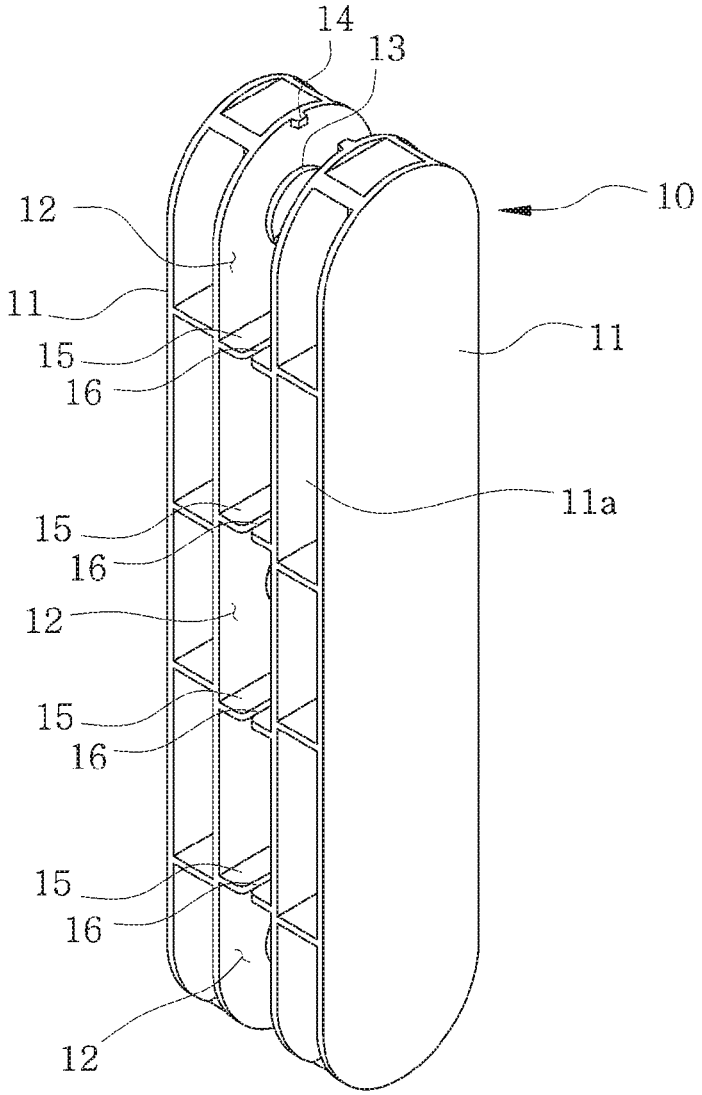
Figure 9:
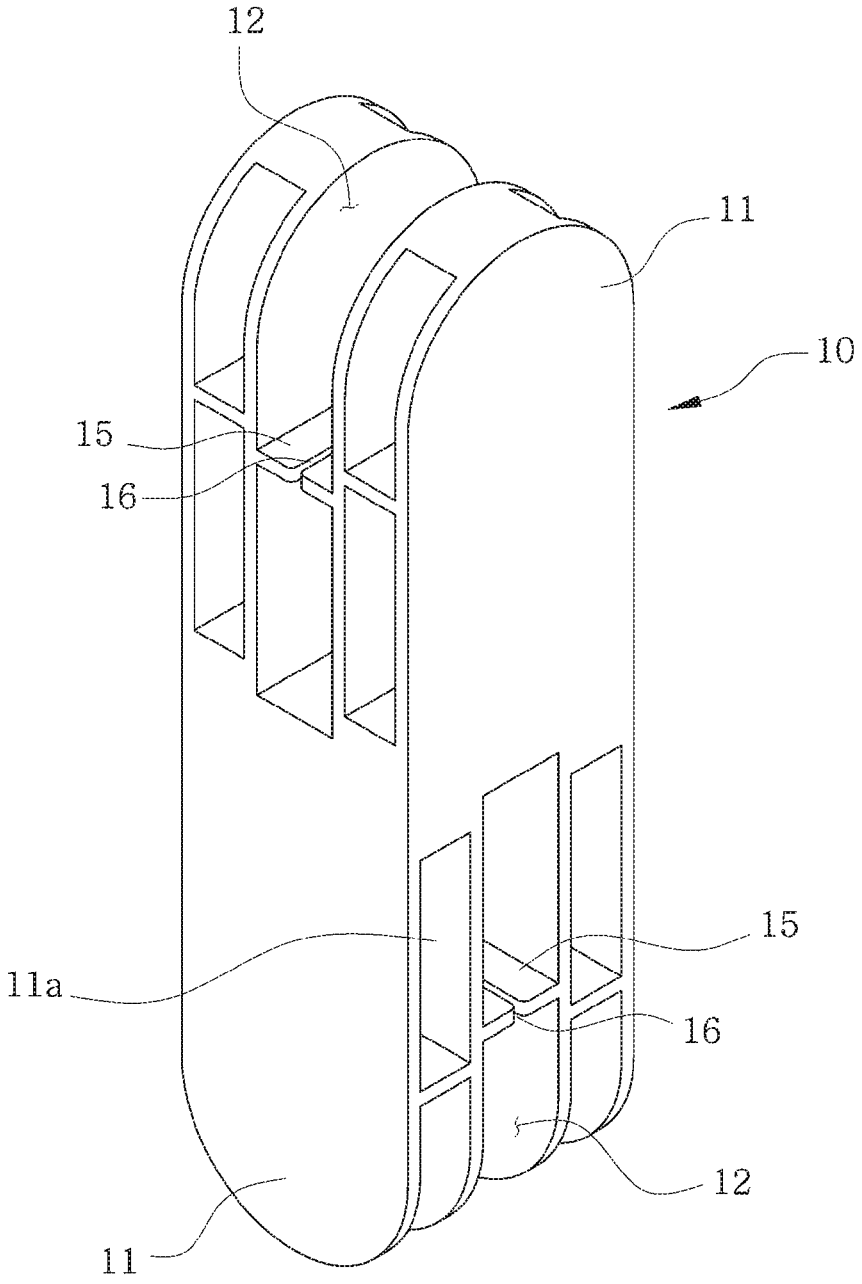

Meanwhile, FIGS. 7 to 9 show various embodiments of an assembly block in which the female coupling part 10 has the coupling spaces 12 coupled with the male coupling part 20 and defined by the partition 15. Although not shown in the drawings, the present invention may include any assembly blocks having the female coupling part 10 having the coupling spaces 12 defined by the partition 15.

Figure 10:
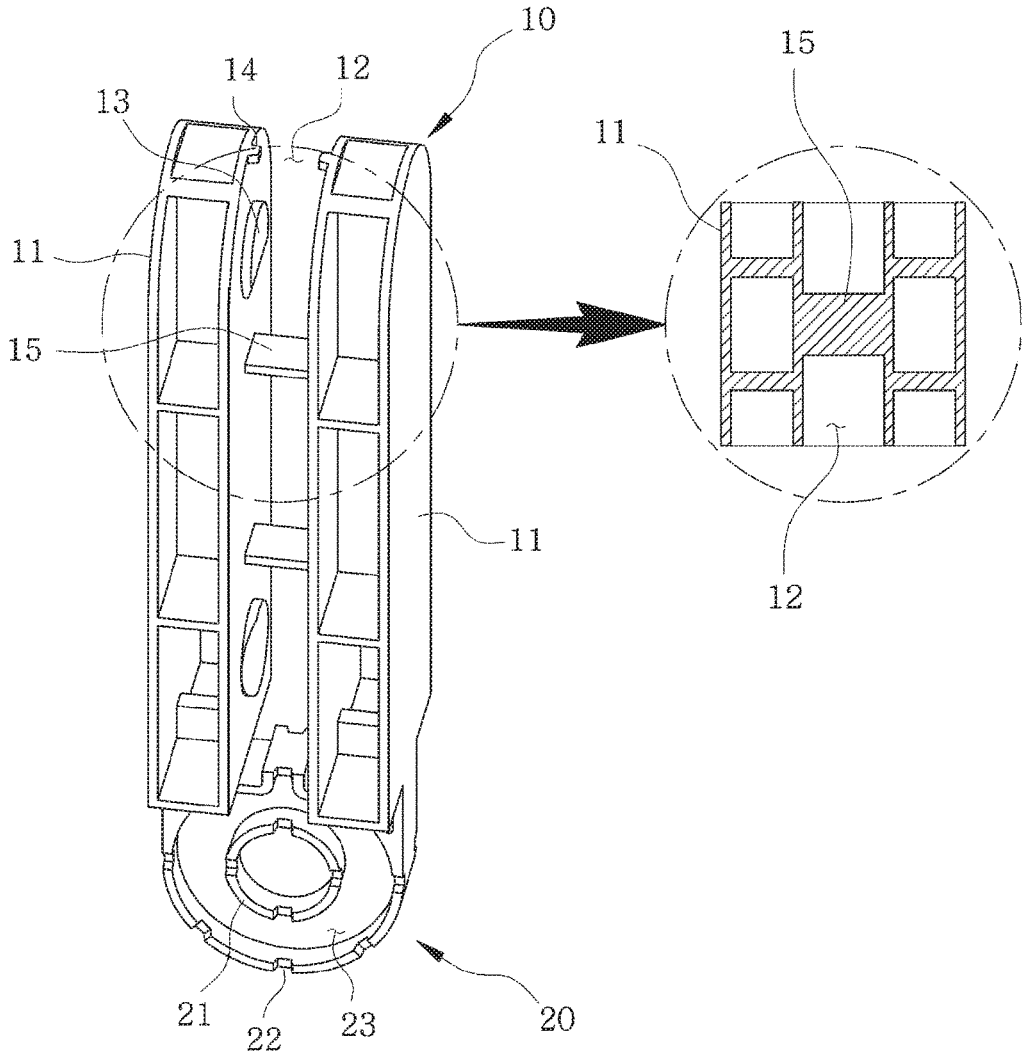
FIG. 10 is a perspective view showing another structure of the partition for the left and right rolling of the female coupling part according the present invention.

FIG. 10 shows another embodiment of the partition 15 which is elastically operated by the right and left rolling, in which the partition 15 is configured to have a width smaller than a width of the vertical support 11 without forming the open groove 16 in the partition 15, and the partition 15 is disposed at a center between the vertical supports 11 that are symmetrically arranged in a vertical direction, such that the vertical support 11 is supported by the partition 15.

Accordingly, the vertical support 11 is supported by the partition 15, and the left and right rolling is identically generated, so that the coupling and decoupling of the male coupling part 20 is facilitated, and the abrasion is prevented from occurring during the rotation.

Figure 11:
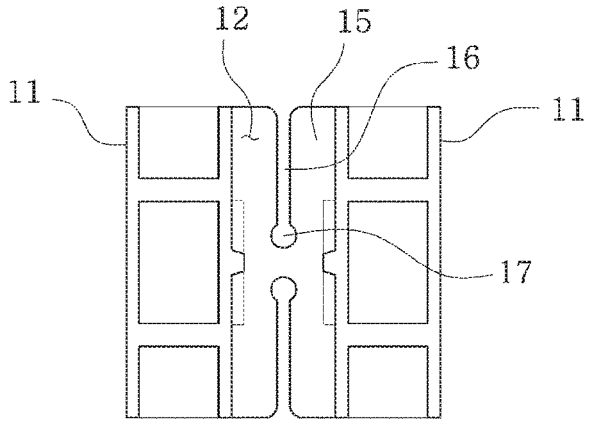
FIG. 11 is a view showing a state of a reinforcing hole that improves an elastic action of the female coupling part according to the present invention.

In addition, FIG. 11 shows another embodiment of the open groove 16 formed in the partition 15, in which a reinforcing hole 17 slightly larger than an incision width of the open groove 16 is formed inward of the open groove 16, and the reinforcing hole 17 has a circular shape or a square shape.

Therefore, when the right and left rolling occurs when the male coupling part 20 is coupled, an elastic resistance that enables the left and right rolling at the open groove 15 is generated to improve an elastic operation, thereby facilitating the coupling and decoupling.

Figure 12:
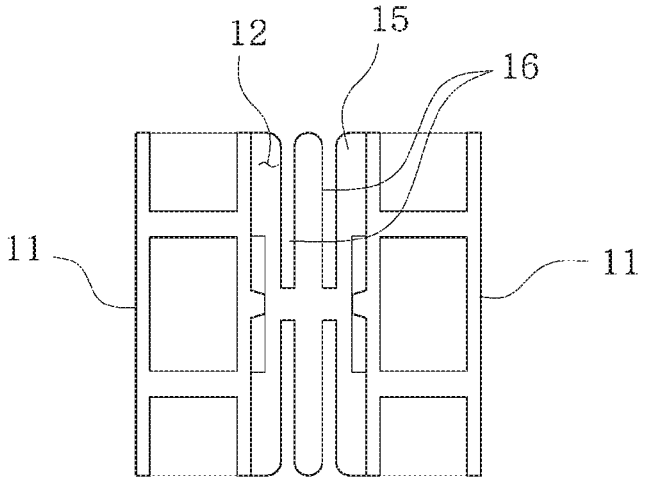
FIG. 12 is a sectional view showing a state in which open grooves are formed in the partition in multi-stages according to the present invention.

In addition, FIG. 12 shows another embodiment of the partition 15, in which the open groove 16 is vertically arranged in multi-stages, so that when the male coupling part 20 is coupled to the coupling space 12 of the female coupling part 10, even if the male coupling part 20 is not inserted in a uniform coupling direction, and the elastic operation caused by the rolling is vertically dispersed due to the male coupling part 20 not assembled from a correct direction, the coupling may be easily achieved.

In other words, when a force is applied in one direction as the male coupling part is coupled, one or more elastic operations occur in a direction in which the force is applied due to the open groove 16 formed in the multi-stages, so that a pressing force applied to the partition 15 is dispersed.

Figure 13:
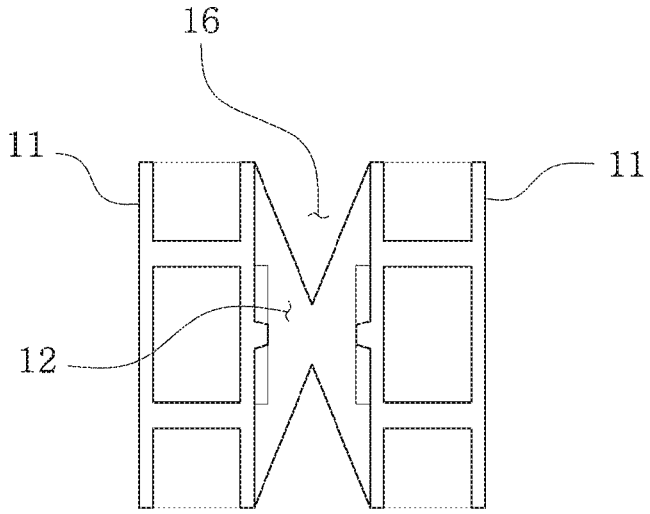
FIG. 13 is a sectional view showing another structure of the open groove according to the present invention.

In addition, FIG. 13 is another embodiment of the open groove 16, in which the open groove 16 has a width gradually narrowing toward an inner side from both outer ends of the partition 15 connected to the vertical supports 11, so that when the right and left rolling occurs as the male coupling part 20 is coupled, an identical elastic operation occurs, and breakage is prevented by reinforcing the partition 15 for connecting and supporting the vertical supports 11 that constitute the female coupling part 10.

Therefore, when the male coupling part 20 is coupled to the coupling spaces 12 defined by the partition 15 of the female coupling part 10, children may easily perform the coupling and decoupling by the elastic operation caused by the right and left rolling, and no friction is generated due to the elastic operation caused by the right and left rolling during the rotation, so that no powder is generated by the abrasion, which allows the children to safely play with the assembly block.

What is claimed is:

1. A chain block toy for facilitating connection and preventing abrasion by being elastically operated via left and right rolling, the chain block toy comprising a plurality of assembly blocks that are interconnectable, each of the plurality of blocks comprising:

a male coupling part; and a female coupling part including:

a pair of vertical supports that are arranged vertically, a partition formed between the vertical supports, the partition including:

first and second ends, a first open groove formed at the first end of the partition and extending toward the second end of the partition, a second open groove formed at the second end of the partition and extending toward the first end of the partition, and a plurality of coupling spaces defined by the partition and the vertical supports, wherein, when the male coupling part is coupled to or decoupled from a female coupling part of another assembly block, or when the male coupling part is rotated in a coupled state, the partition is rolled left and right such that, the first open groove is widened at the first end and the second open groove is narrowed at the second end, which facilitates the coupling or decoupling of the male coupling part from the female coupling part of the other assembly block, and the female coupling part prevents the male coupling part from being abraded by reducing friction when the male coupling part is rotated.

2. The chain block toy of claim 1, wherein the partition is disposed at a center between the vertical supports that are symmetrically arranged in a vertical direction, such that the vertical supports are supported by the partition, and wherein the left and right rolling is identically generated.

3. The chain block toy of claim 1, further comprising:

a reinforcing hole including at least one of a circular shape or a square shape, which is slightly larger than an incision width of the open groove, wherein the reinforcing hole is formed inward of the open groove formed in the partition, such that an elastic resistance is generated by the left and right rolling to improve an elastic operation.

4. The chain block toy of claim 1, wherein the open groove formed in the partition is vertically arranged in multi-stages.

5. The chain block toy of claim 1, wherein the open groove is inclined toward an inner center from both outer ends of the partition.

* * * * *